US005205110A

United States Patent [19]

Buchko

[11] Patent Number: 5,205,110

[45] Date of Patent: Apr. 27, 1993

[54] SERVO MOTOR OPERATED INDEXING MOTION PACKAGING MACHINE AND METHOD

[76] Inventor: Raymond G. Buchko, 1016 E. Florida Ave., Appleton, Wis. 54911

[21] Appl. No.: 626,278

[22] Filed: Dec. 12, 1990

[51] Int. Cl.[5] ..... B65B 47/02; B65B 47/10

[52] U.S. Cl. ..... 53/453; 53/559

[58] Field of Search ..... 53/453, 454, 559, 560, 53/561

[56] References Cited

U.S. PATENT DOCUMENTS

| | | | |
|---|---|---|---|
| 3,808,772 | 5/1974 | Turtschan | 53/559 X |
| 4,094,127 | 6/1978 | Romagnoli | 53/559 X |
| 4,894,977 | 1/1990 | Rittinger et al. | 53/453 |
| 4,897,985 | 2/1990 | Buchko et al. | 53/559 |
| 4,938,001 | 7/1990 | Vico | 53/559 X |
| 4,999,979 | 3/1991 | Vicq | 53/559 |

*Primary Examiner*—James F. Coan

*Attorney, Agent, or Firm*—Andrus, Sceales, Starke & Sawall

[57] ABSTRACT

An indexing motion apparatus and method for vacuum packaging of articles such as hot dogs, sliced luncheon meat, cheese or pharmaceuticals. A lower web of packaging material is indexingly advanced by a lower web drive driven in an indexing manner by a servo motor. Forming tooling is provided for vacuum forming the lower web to form one or more product cavities, and the forming tooling is movable between raised and lowered positions by a lifting and lowering system driven by a servo motor. A plug assist mechanism is provided for assisting the web to conform to the forming cavities. The plug assist mechanism is also movable in response to operation of servo motors, which actuate a pair of linear actuators. After the formed product cavities are loaded with product, the cavities are evacuated and an upper web applied to vacuum package the product. A slitting mechanism severs the upper and lower webs into individual product packages. The servo motors are programmable and provide accurate position of the components of the packaging machine, and also provide ease in changing the various parameters of the packaging machine according to the type of product being packaged.

28 Claims, 5 Drawing Sheets

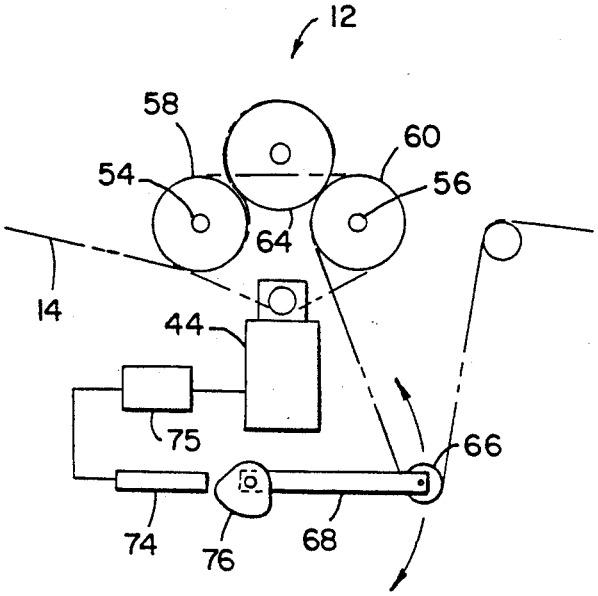
FIG. 3
FIG. 5
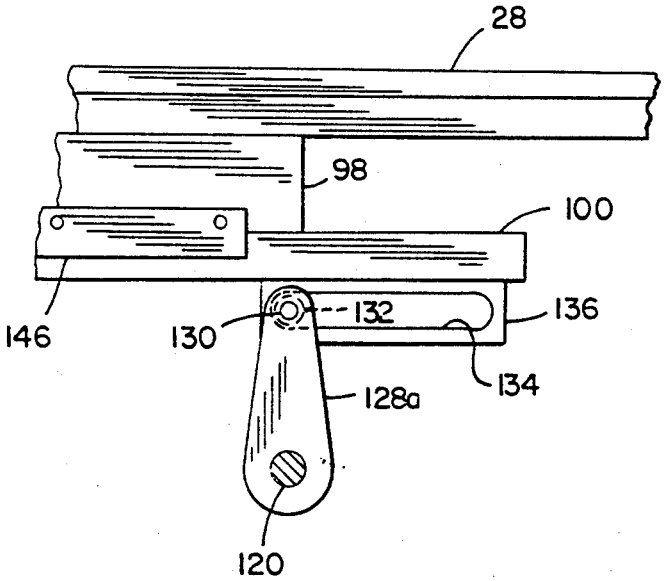

SERVO MOTOR OPERATED INDEXING MOTION PACKAGING MACHINE AND METHOD

BACKGROUND AND SUMMARY

This invention relates to an indexing motion machine and method for producing discrete packages of articles, such as vacuum packaged food products or the like.

To produce discrete individual packages of food products such as frankfurters, sliced luncheon meat, cheese or the like, it has been known to employ packaging machines providing either continuous motion or indexing motion. Continuous motion machines typically provide a higher rate of package production than indexing machines. However, indexing machines have been in existence for a long time, and their design is well refined. Accordingly, indexing machines are reliable in operation.

The present invention has as its object to provide an indexing motion package forming machine which is capable of producing packages at a rate equivalent to or greater than the rate at which packages can be produced on a continuous type machine. A further object of the invention is to provide an indexing motion package forming machine utilizing motors with programmable controls to control the movement of the various components of the package forming machine, to provide accurate positioning of the machine components and to provide variability in the package dimensions to accommodate packaging of different products.

In accordance with one aspect of the invention, a packaging machine includes a forming station in which a flexible web of packaging material is deformed so as to provide a cavity adapted to receive the product to be packaged. Forming tooling defines the forming cavity, and the tooling is movable between a first position in which it engages the web of packaging material and acts on the web to form the web into the forming cavity, and a second position in which the tooling is moved away from web. The forming tooling is moved between its first and second positions by a motor having a rotatable output shaft and including a programmable controller associated therewith. A lifting and lowering system is interposed between the forming tooling and the motor output shaft for moving the forming tooling between its first and second positions in response to rotation of the motor output shaft. In a preferred embodiment, the lifting and lowering system includes a cam-type arrangement in which structure defining a cam slot is mounted to the forming tooling, and an arm is mounted to and rotatable with a rotatable member which is driven through a timing belt or the like in response to rotation of the motor output shaft. A roller member is mounted to the arm and is engaged within the cam slot, and alternating clockwise/counterclockwise rotation of the rotatable member causes back and forth movement of the roller within the cam slot to lift and lower the forming tooling.

This aspect of the invention further contemplates a method of forming a product cavity in a flexible web of packaging material, substantially in accordance with the foregoing summary.

In accordance with another aspect of the invention, a packaging machine includes an indexing mechanism for supplying a flexible web of packaging material to the forming station of the packaging machine. A movable advancement mechanism is provided for gripping the flexible web, and preferably comprises a pair of spaced chains. Each chain is preferably provided with a series of gripper members along its length, which grip the edges of the web. A motor having a rotatable output shaft and having a programmable controller associated therewith, is drivingly engaged with the pair of chains. Intermittent operation of the motor provides indexing advancement of the web to the forming station. The forming station includes forming tooling for deforming the flexible web to form a cavity adapted to receive product to be packaged.

The invention further contemplates a method of indexingly advancing a web of packaging material in a packaging apparatus, substantially in accordance with the foregoing summary.

In accordance with yet another aspect of the invention, a packaging machine includes a forming station in which a flexible web of packaging material is supplied to the forming station. A forming box is located at the forming station and includes an internal forming cavity. The forming box is movable to a forming position in which the web is located over the forming cavity. A vacuum mechanism provides negative air pressure to the forming cavity of the forming box when the forming box is in its forming position. A plug assist mechanism assists the web to conform to the contour of the forming cavity when the forming box is in its forming position. The plug assist mechanism comprises a plug member reciprocably movable between an operative position in which it engages the web and moves the web within the cavity to assist the web to conform to the cavity, and an inoperative position in which the plug member is withdrawn from the cavity. A motor having a rotatable output shaft and a programmable controller associated therewith is provided for reciprocably moving the plug member between its operative and inoperative positions in response to operation of the motor. In a preferred embodiment, the plug member is mounted to a frame assembly, and the plug member is reciprocably movable between its operative and inoperative positions by lowering and raising the frame assembly in response to rotation of the motor output shaft, for moving the plug member between its operative and inoperative positions. In a particularly preferred embodiment, the frame assembly is lowered and raised by means of a linear actuator connected between the motor output shaft and the frame assembly for lowering and raising the frame assembly in response to alternating clockwise/counterclockwise rotation of the motor output shaft.

This aspect of the invention further contemplates a method of assisting a flexible web of packaging material to conform to a forming cavity, substantially in accordance with the foregoing summary.

In accordance with yet another aspect of the invention, a packaging machine and method incorporates forming tooling, an indexing web drive, and a plug assist mechanism, each of which is independently driven by one or more motors having programmable controllers, so as to allow each component to be independently programmed and controlled. This provides variability in the type of package which can be formed by the machine, as well as providing accurate control and adjustment of the various packaging components.

In each of the above-noted aspects of the invention, the motor preferably comprises a programmable servo motor.

Various other features, objects and advantages of the invention will become apparent from consideration of the following description taken together with the drawings.

BRIEF DESCRIPTION OF THE DRAWINGS

The drawings illustrate the best mode presently contemplated of carrying out the invention.

In the drawings:

FIG. 3 is a schematic side view showing the web unwinding mechanism for supplying the lower web of packaging material;

FIG. 5 is an enlarged partial side view showing the forming tooling in its raised position;

DETAILED DESCRIPTION OF THE PREFERRED EMBODIMENT

Figure 1:
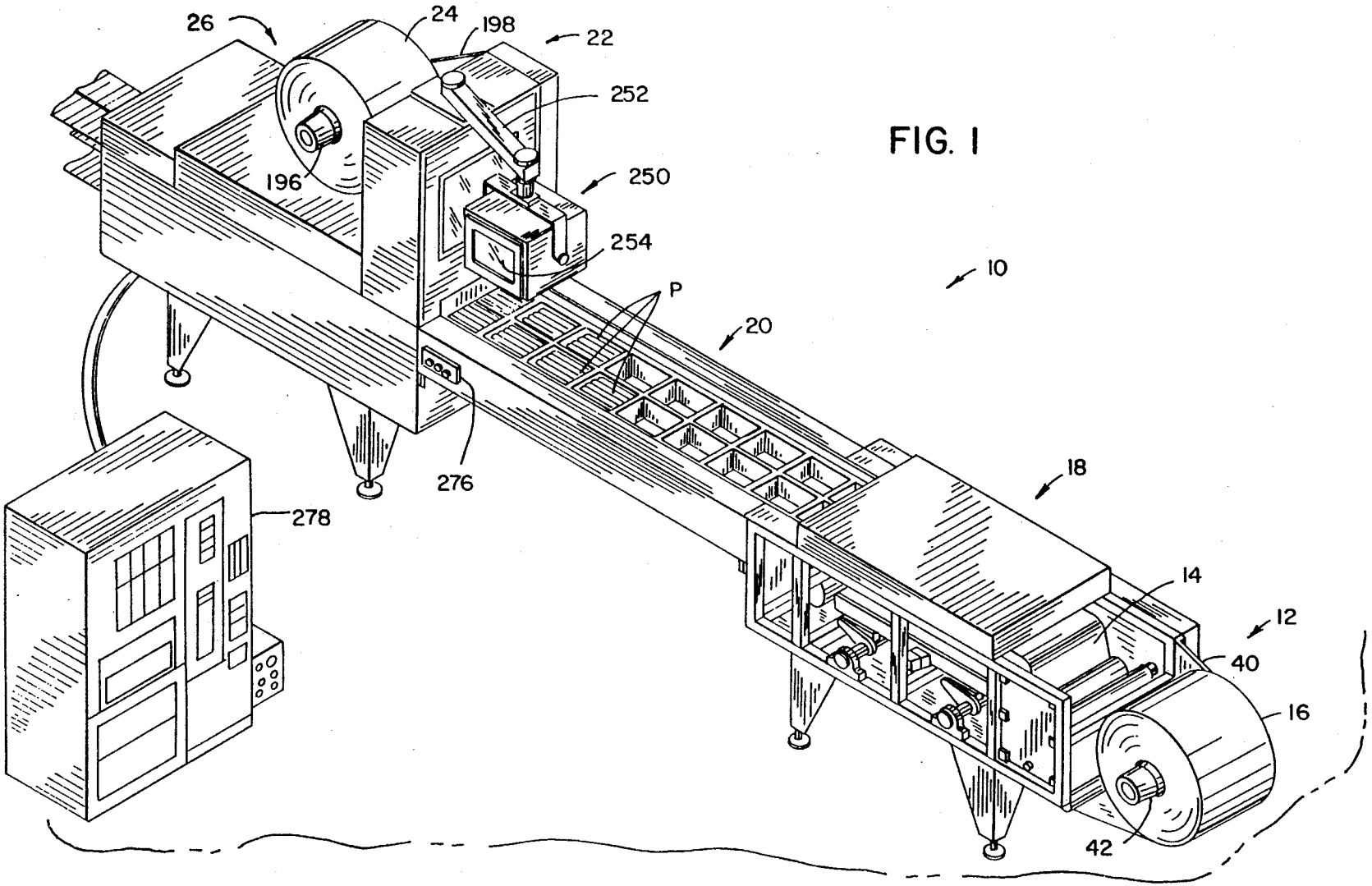
FIG. 1 is an isometric view of a packaging machine constructed according to the invention.
Figure 2:
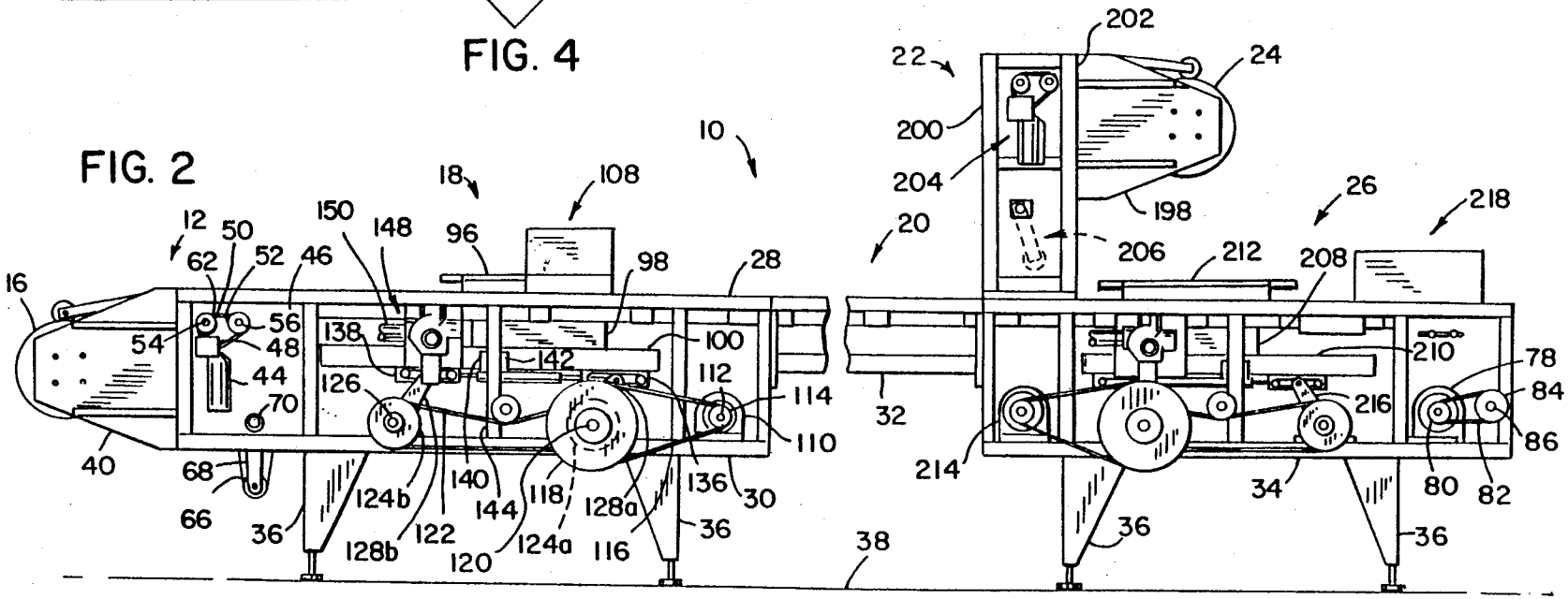
FIG. 2 is a side elevation view of the packaging machine of FIG. 1, with guards and covers removed to expose the components of the machine.

FIGS. 1 and 2 illustrate a packaging machine 10 constructed according to the invention. Packaging machine 10 generally includes a lower web supply station 12 for supplying a lower web 14 of flexible packaging material from a supply roll 16, a forming station 18, a loading station 20, an upper web supply station 22 for supplying an upper web of flexible packaging material from a supply roll 24, and a downstream station shown generally at 26. The operations performed at downstream station 26 will later be explained.

The various components of packaging machine 10 are mounted to and supported by a frame assembly (FIG. 2) including a pair of spaced parallel upper frame members 28, lower spaced frame members such as shown at 30, 32, and 34, and a series of vertical frame members extending between upper frame member 28 and lower frame members 30, 32 and 34. A series of legs 36 are provided for supporting machine 10 above a floor 38.

Lower web supply station 12 includes a roll support bracket 40 and an unwind shaft 42 extending from bracket 40. Supply roll 16 is mounted to shaft 42, which is rotatably mounted to bracket 40, for allowing rotation of supply roll 16 An unwind motor 44 (FIG. 2) is mounted to a plate 46, and has its output shaft engaged with a gear box 48 which includes a horizontally oriented output shaft driven in response to rotation of the output shaft of motor 44. A pair of timing pulleys 50, 52 are fixed to a pair of shafts 54, 56, respectively, which extend through plate 46 and are fixed to a pair of driven steel rollers 58, 60 (FIG. 3). A timing belt 62 is trained 10 around timing pulleys 50, 52 and a timing pulley (not shown) engaged with the horizontal output shaft of gear box 48.

Referring to FIG. 3, a rubber surfaced nip roller 64 rests on top of driven rollers 58 and 60, forming a pair of nips between roller 64 and rollers 58, 60. Lower web 14 is fed below driven roller 58, up and over nip roller 64, and below driven roller 60. Upon operation of motor 44, drive rollers 58 and 60 are driven in response to rotation of timing pulleys 50, 52, and lower web 14 is unwound from supply roll 16 by rotation of driven rollers 58, 60 and nip roller 64.

Motor 44 is a conventional variable speed DC motor, which provides variable speed unwinding of lower web 14 from supply roll 16 during its operation.

From driven roller 60, lower web 14 is trained around a dancer roller 66 rotatably mounted to a dancer arm 68, which is pivotably supported at its upper end on a shaft 70 extending between the sides of the machine frame. As noted previously, and as will be explained in greater detail, web 14 is advanced through machine 10 in an indexing fashion. The dancer assembly, consisting of dancer arm 68 and dancer roller 66, acts as an actuator for switching unwind motor 44 on and off and for controlling its speed of operation, for providing unwinding of lower web 14 from supply roll 16 in response to indexing movement of lower web 14 through the stations downstream of the dancer assembly.

As noted previously, unwind motor 44 is a variable speed motor. Motor 44 is responsive to the position of dancer arm 68 which increases or decreases the motor speed as required to accommodate the indexing advancement of lower web 14 downstream of the dancer assembly. Motor 44 is normally off, and the dancer assembly selectively actuates motor 44 and controls its speed of operation.

Referring to FIG. 3, transducer-type proximity switch 74 is mounted to lower frame member 30, and is interconnected with unwind motor 44 through a motor drive 75. A cam-shaped switch actuator member 76 is mounted to dancer arm 68, for selectively actuating proximity switch 74.

Actuator member 76 provides a cam-shaped actuator surface, which acts on proximity switch 74 to control the speed of operation of motor 44. As noted previously, motor 44 is normally off. The cam shape of actuator member 76 provides gradual switching of motor 44 between its "on" and "off" modes.

When lower web 14 is pulled by the indexing drive mechanism, as will be explained, dancer arm 68 pivots counter-clockwise so as to bring actuator member 76 into proximity with switch 74. Proximity switch 74 then causes motor 44 to operate, first at a low speed and then at a higher speed as dancer arm 68 further pivots counter-clockwise, until motor 44 is operating at full speed, to unwind lower web 14 from supply roll 16. As the supply of lower web 14 from supply roll 16 catches up with the indexing advancement of lower web 14, dancer arm 68 pivots about shaft 70 in a clockwise direction. Actuator member 76 then causes proximity switch 74 to slow the speed of operation of motor 44. When the indexing advancement of lower web 14 ceases, motor 44 Continues to supply lower web 14 to dancer roller 66 and dancer arm 68 is pivoted clockwise until actuator member 76 is moved an amount sufficient to cut off power to motor 44 through proximity switch 74.

Dancer arm 68 thus moves in an arcuate back and forth manner as long as actuator member 76 is maintained in proximity to proximity switch 74 during indexing advancement of web 14 downstream of the dancer assembly continues.

To advance lower web 14, a servo motor 78 is mounted to lower frame members 34, and includes an output shaft to which a timing pulley 80 is mounted. A timing belt 82 is trained around timing pulley 80, and also around a driven timing pulley 84 mounted to a driven shaft 86. Driven shaft 86 is rotatably supported between the sides of the frame of packaging machine 10.

Figure 6:
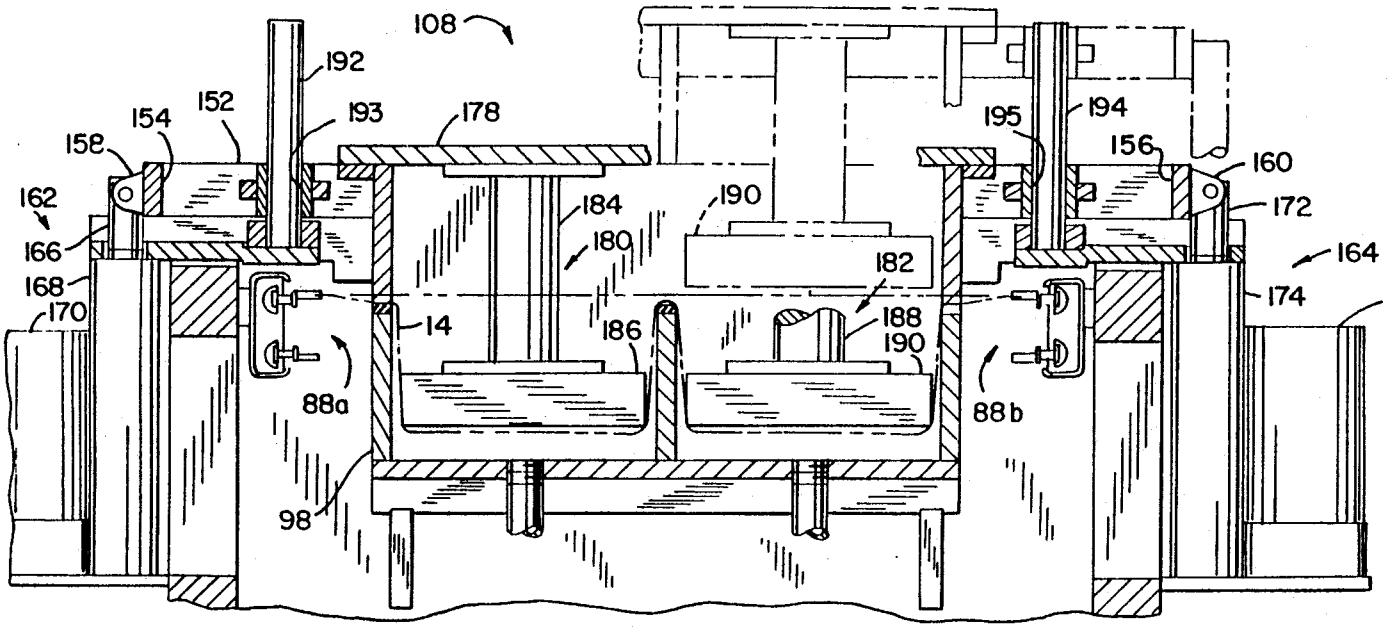
FIG. 6 is a partial transverse sectional view illustrating the plug assist mechanism of the invention.
Figure 7:
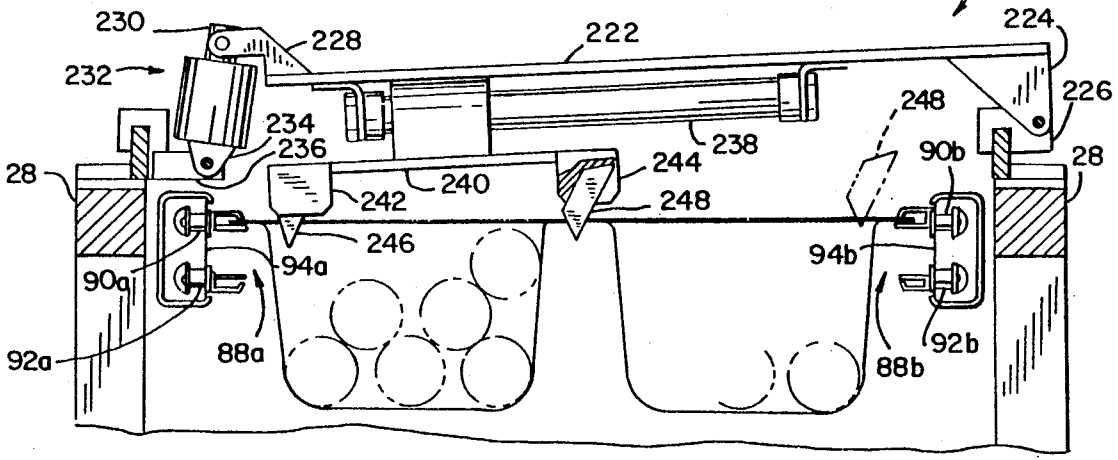
FIG. 7 is a partial transverse sectional view showing a cutting assembly for transversely cutting the formed packages.

Referring briefly to FIGS. 6 and 7, a pair of gripper chains shown generally at 88*a* and 88*b*, are provided on either side of the frame of packaging machine 10.

Gripper chains 88*a* and 88*b* provide upper runs 90*a* and 90*b*, respectively, and lower runs 92*a* and 92*b*, respectively. The upper and lower runs of chains 88*a*, 88*b* are mounted in inwardly facing slots formed in facing nylon blocks 94*a*, 94*b*, located on either side of the frame of packaging machine 10. Blocks 94*a*, 94*b* are mounted to upper frame members 28, and provide sliding movement of gripper chains 88*a*, 88*b* along the length of packaging machine 10.

Gripper chains 88*a*, 88*b* may be such as manufactured by Curwood, Inc. of Oshkosh, Wis. under its U.S. Pat. No. 4,915,283. This arrangement provides gripping of lower web 14 along its edges at upper runs 90*a*, 90*b*, of gripper chains 88*a*, 88*b*.

Driven shaft 86 (FIG. 2), which is rotatable in response to rotation of the output shaft of indexing drive servo motor 78, has a pair of chain drive sprockets (not shown) connected thereto for engagement with gripper chains 88*a*, 88*b*. In this manner, intermittent operation of servo motor 78 provides indexing movement of gripper chains 88*a*, 88*b*, to indexingly advance lower web 14 through packaging machine 10

Lower web 14 is gripped between upper runs 90*a*, 90*b* of gripper chains 88*a*, 88*b* downstream of the dancer assembly and upstream of forming station 18, and is thereafter supplied to forming station 18 in an indexing fashion.

A web heater apparatus, shown generally at 96, is located immediately upstream of forming station 18 for heating lower web 14 prior to forming of web 14 at forming station 18. The preheating of web 14 imparts increased flexibility to web 14 to assist in deforming web 14 at forming station 18.

Forming tooling is provided at forming station 18 below web 14. As shown in FIG. 2, the forming tooling comprises a chilled forming box 98 mounted to a frame assembly 100. As will be explained, forming box 98 is movable between a raised position and a lowered position. In its raised position, forming box 98 acts on lower web 14 to deform web 14 downwardly to form a product cavity, and in its lowered position is moved away from web 14 so as to allow advancement of web 14 with the product cavity formed therein.

Figure 4:
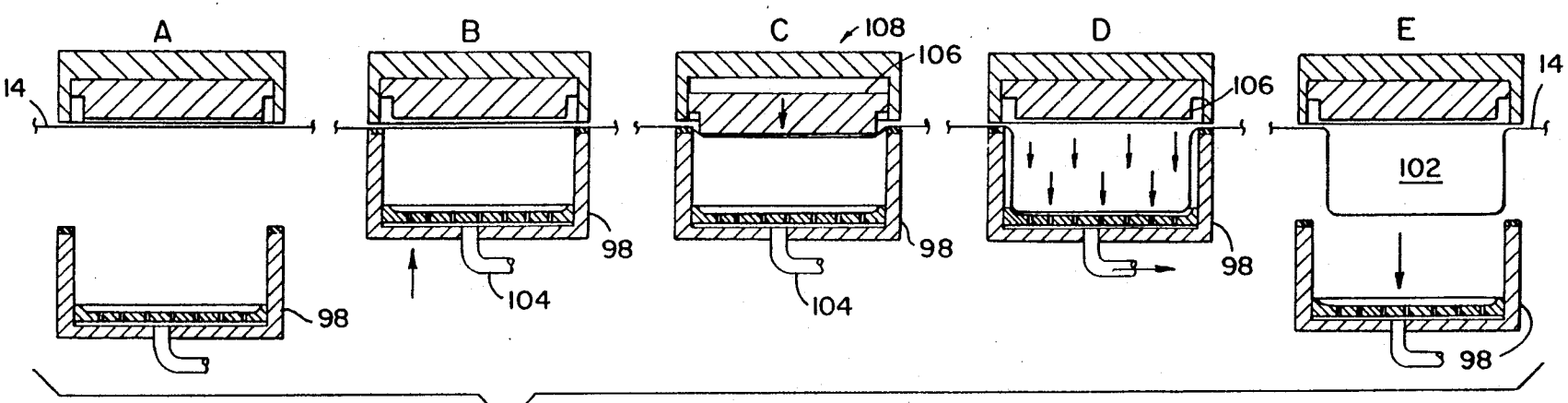
FIG. 4 is a schematic view showing the steps involved in deforming the flexible web of packaging material at the forming station to provide a product cavity adapted to receive product to be packaged.

FIG. 4 illustrates the series of steps which take place at forming station 18 in order to form a product cavity 102 in lower web 14. At position A, forming box 98 is in its lowered position, and an undeformed portion of web 14 is located over the open upper end of forming box 98. While web 14 is maintained stationary, forming box 98 is moved upwardly to position B, where the upper ends of the side walls of forming box 98 come into contact with the underside of web 14. Negative air pressure is then supplied to the interior of forming box 98 through a vacuum line 104 and a series of air passages formed in the bottom of forming box 98. At position C, a plug member 106 associated with a plug assist mechanism 108, which will later be explained in greater detail, moves downwardly so as to come into contact with the upper surface of lower web 14 and to assist web 14 in deforming into the interior of forming box 98. At position D, plug member 106 is retracted to its upper position, and the negative air pressure supplied by vacuum line 104 deforms lower web 14 downwardly into the interior of forming box 98 until the lower surface of web 14 is disposed against the bottom and sides of the interior of forming box 98. Product cavity 102 is thus formed. At position E, forming box 98 is moved downwardly an amount sufficient to allow formed web 14 to advance downstream from forming station 18, whereafter the described sequence of steps is repeated to again form another product cavity 102 in the upstream portion of lower web 14. The previously formed product cavity 102 is advanced to loading station 20, where product to be packaged is placed into product cavity 102.

Referring to FIG. 2, a servo lift motor 110 is mounted to lower frame members 30, and includes an output shaft 112 to which a drive timing pulley 114 is mounted. A timing belt 116 is trained around drive pulley 114 and a large driven pulley 118, which is mounted to a shaft 120 rotatably mounted between lower frame members 30. A smaller diameter lift pulley 124*a* is connected to shaft 120 on the inside surface of large timing pulley 118, and a timing belt 122 is trained around inside-mounted pulley 124*a* and around a second lift pulley 124*b*. Pulley 124*b* is keyed to a shaft 126, which is rotatably mounted to lower frame members 30. With this arrangement, the pair of lift pulleys 124*a* and 124*b* are rotatable in response to operation of servo motor 110.

A pair of lift arms 128*a* and 128*b* are mounted to lift pulleys 124*a* and 124*b*. Lift arms 128*a* and 128*b* are fixed at their lower ends to shafts 120, 126, respectively, and therefore are pivotable with shafts 120, 126 in response to operation of lift servo motor 110.

As shown in FIG. 5, lift arm 128*a* is provided with an inwardly extending upper shaft 130 to which is mounted a roller member 132. Roller member 132 is mounted within a cam slot 134 formed in a cam member 136 which is connected to the underside of frame assembly 100. With this arrangement, upon reciprocating clockwise and counter-clockwise movement of shaft 120 resulting from reciprocating operation of lift servo motor 110, roller member 130 is caused to move back and forth in cam slot 134 to raise and lower frame assembly 100, to which forming box 98 is mounted. Referring to FIG. 2, a cam member 138 is mounted to the rear portion of frame assembly 100, and includes a cam slot similar to slot 134 formed in forward cam member 136. Rear lifting arm 128*b* is provided with a roller arrangement similar to that described with respect to arm 128*a*. Timing belt 122 trained around lift pulleys 124 provides simultaneous lifting and lowering of lift arms 128*a* and 128*b* to raise and lower frame assembly 100. To ensure that lift arms 128*a* and 128*b* remain parallel to each other, a mechanical link (not shown) is connected between arms 128*a* and 128*b*.

In a preferred arrangement, a pair of forward cam members are mounted one on either side of the forward portion of frame 100, and a pair of forward lift arms 128*a* are connected to shaft 120. Similarly, a pair of cam members 138 are mounted one on either side of the rear portion of frame 100, and a pair of lift arms 128*b* are mounted to shaft 126.

As shown in FIG. 2, a pair of plastic bearing blocks 140, 142 are mounted to the side of frame assembly 100, and a similar pair of blocks are mounted to the opposite side of frame assembly 100. Bearing blocks 140, 142 are located one on either side of a vertical shaft mounted to the inside of vertical frame member 144, and a similar arrangement is provided on a vertical frame member on the other side of machine 10. Bearing blocks 140, 144 provide vertical tracking of frame assembly 100 during lifting and lower of lift arms 128*a*, 128*b*.

Referring to FIG. 5, forming box 98 is mounted to frame assembly 100 by means of a pair of side plates located on either side of forming box 98, with one of the side plates being shown at 146. By loosening the side plates, forming box 98 can be moved to varying positions along the length of frame assembly 100, and thereafter fixed in a desired position by retightening the side plates. This provides accurate positioning of forming box 98 on frame assembly 100. In addition, forming box 98 can be completely removed from frame assembly 100 and replaced with a different forming box providing a different configuration to the product cavity, to accommodate variations in the type of product being packaged.

As shown in FIG. 2, a vacuum junction 148 is mounted to the frame of machine 10 for transferring negative air pressure from a vacuum tube 150 to the interior of forming box 98 through vacuum line 104 (not shown in FIG. 2), in accordance with known principles.

FIG. 2 generally illustrates the location of plug assist mechanism 108 at forming station 18. FIG. 6 illustrates plug assist mechanism 108 in greater detail.

Referring to FIG. 6, plug assist mechanism 108 includes a frame assembly consisting of front and rear frame members, one of which is shown at 152. A pair of side plate members 154, 156 extend between the front and rear frame members. A pair of lugs 158, 160 are mounted to side frame members 154, 156, respectively.

A pair of linear actuator assemblies 162, 164 are provided one on either side of the frame of machine 10 and are mounted to the structural members of the frame. Actuator assembly 162 includes a linearly movable output member 166 which is vertically movable relative to an actuator body 168. A servo motor 170 is mounted to actuator body 168, for providing rotary input power to actuator body 168 and to provide selective up-down movement of output member 166. Output member 166 is connected to plug assist frame lug 158.

Linear actuator assembly 164 is similarly constructed, providing a vertically movable output member 172, a linear actuator body 174 and a servo motor 176. Output member 172 is connected to frame lug 160.

Linear actuator assemblies 162, 164 are preferably those such as manufactured under U.S. Pat. No. 4,137,784.

With the described arrangement, operation of servo motors 170, 176 results in rotary input power being provided to linear actuator bodies 168, 174, to provide vertical movement of linear actuator output members 166, 172, and thereby lifting and lower of the plug assist frame assembly relative to the frame of packaging machine 10.

An upper plate 178 extends between the front and rear frame members of the plug assist assembly. In the illustrated embodiment, forming box 98 provides a pair of internal cavities to form lower web 14 so as to provide a pair of side-by-side product cavities. A pair of plug assist members, shown generally at 180, 182, are mounted to the underside of upper plate 178 for assisting lower web 14 in conforming to the contour of the internal cavities provided by forming box 98. Plug assist member 180 includes a vertical post 184 and a lower forming member 186 connected to the lower end of post 184. Similarly, plug assist member 182 includes a vertical post 188 connected to the underside of upper plate 178, and a forming member 190 mounted to the lower end of post 188.

Forming members 186, 190 are dimensioned so as to fit within the internal cavity provided in forming box 98 with which each is aligned. Preferably, each edge of forming members 186, 190 are located approximately ½ inch inwardly from the side wall of the cavity to which it is adjacent. Forming members 186, 190 are preferably moved downwardly within the respective forming cavities to a lowermost position in which the bottom of each of forming members 186, 190 is at approximately three quarters of the depth of the cavity.

A pair of vertical guide posts 192, 194 are mounted to the frame of packaging machine 10. Post 192 is received within an opening 193 defined by structure extending between the front and rear frame members of plug assist assembly 108, with the opening having a cross section corresponding to and slightly larger than the cross section of post 192. Similarly, post 194 is received within an opening 195 defined by structure extending between the front and rear frame members of plug assist assembly 108, with the opening providing a cross section corresponding to and slightly larger than the cross section of post 194. With this arrangement, posts 192 and 194 ensure vertical movement of plug assist assembly 108 during operation of linear actuator assemblies 162, 164 in response to operation of servo motors 170, 176.

Forming members 186, 190 are shown in their lowermost position in solid lines in FIG. 6. Forming member 190 is shown in its raised position in phantom.

In accordance with known principles, forming members 186, 190 engage lower web 14 and move lower web 14 downwardly, to assist it in conforming to the forming cavities of forming box 98.

Referring to FIGS. 1 and 2, after the formed lower web is discharged from forming station 18 where it is deformed to provide side-by-side product cavities, the product, shown at P in FIG. 1, is loaded into the product cavities at loading station 20. Product P may be loaded in any satisfactory manner, such as by hand or by an automated loading system. Product P as illustrated in FIG. 1 comprises hotdogs, but it is understood that product P could be any product which is satisfactorily packaged in the manner disclosed, such as ham, bacon, sliced luncheon meat, cheese, pharmaceuticals, or the like.

After the product cavities are loaded with product P, the formed and loaded lower web is moved to upper web supply station 22.

Upper web supply station 22 (FIG. 2) is arranged similarly to lower web supply station 12, and functions in a similar manner. Upper web supply roll 24 is rotatably supported on a shaft 196 rotatably mounted to a bracket assembly 198. A pair of vertical frame members 200, 202 extend upwardly from upper frame members 28 of packaging machine 10, for supporting upper web supply station 22.

An unwinding drive assembly, shown generally at 204, is mounted to the frame of upper web supply station 22 for unwinding upper web material from supply roll 24. The components of unwind drive assembly 204 are the same as those described previously with respect to lower web supply station 12, and function in the same manner as such components. Upper web supply station 22 further includes a dancer assembly 206 which functions in the same manner as the dancer assembly located at lower web supply station 12, for providing selective unwinding of upper web material from supply roll 24 by unwind drive assembly 204 in response to indexing movement of the upper web along with the formed and loaded lower web.

At downstream station 26, a vacuum box 208 is mounted to a frame 210, and is operable in accordance with known vacuum packaging principles to evacuate the product cavities while the upper and lower webs are sealed together, to provide a vacuum package of product P. A heating assembly 212 is located at downstream station 26 to impart flexibility to the upper web prior to its being sealed to lower web 14.

Frame 210 is movable between a raised and lowered position in the same manner as frame assembly 100 located at forming station 18. A lift servo motor 214 is provided for imparting selective lifting and lowering of a pair of lift arms, one of which is shown at 216, through a timing belt and pulley arrangement similar to that described previously at forming station 18.

After the product cavities are evacuated and the upper and lower webs are bonded together to provide a vacuum package for product P, the bonded upper and lower webs are advanced to a cutting station, shown generally in FIG. 2 at 218. As the webs exit cutting station 218, a centrally located cutting blade severs the webs longitudinally to separate the two lanes of formed packages. Prior thereto, a cross-cut mechanism, shown in FIG. 7 generally at 220, then severs the webs transversely.

Cross-cut mechanism 220 includes a frame assembly including an upper frame member 222 and a bracket member 224, which is pivotably mounted to a support member 226 mounted to upper frame member 28 of packaging machine 10. A bracket member 228 is located at the other end of upper frame member 222, and is connected to the extendable and retractable output member 230 of a cylinder assembly shown generally at 232. A bracket 234 connects the lower end of cylinder assembly 232 to a support member 236, which is interconnected with frame member 28 of packaging machine 10.

Cylinder assembly 232 may be any satisfactory assembly for raising and lowering output member 230, such as a pneumatic or hydraulic cylinder, or a solenoid-type arrangement. With this construction, upper frame member 222 is movable between a lowered position as shown in FIG. 7, and a raised position.

A rodless hydraulic cylinder 238 is mounted to the underside of upper frame member 222, and a carriage 240 is connected to the movable output member of rodless cylinder 238. A pair of blade holder assemblies 242, 244 are mounted to the ends of carriage 240, and retain a pair of knife blades 246, 248.

Operation of rodless cylinder 238 provides a cutting stroke to carriage 240 for drawing blades 246, 248 rightwardly through the upper and lower webs, to transversely sever the webs. The output member of rodless cylinder 238 is first moved to its leftwardmost position, so that blade 246 is disposed leftwardly of the leftward edges of the upper and lower webs, and blade 248 is located in the area between the two lanes of formed packages. Output member 230 of cylinder assembly 232 is then retracted, so that the points of blades 246, 248 pierce the upper and lower webs. Rodless cylinder 238 is then operated to move carriage 240 rightwardly, and blades 246, 248 cut through the upper and lower webs to completely sever the webs. Upon a full cutting stroke of rodless cylinder 238, blade 246 is moved rightwardly an amount sufficient to sever the webs up to the point where blade 248 initially pierced the webs. Blade 248 is moved completely through the webs to clear the rightward edges of the webs. Output member 230 of cylinder 232 is then extended to raise blades 246, 248 above the webs, and the output member of rodless cylinder 238 is then moved leftwardly to bring the blades back to their original position, whereafter output member 230 is again retracted to bring blades 246, 248 into contact with the webs.

Blades 246, 248 are conventional blades as used in a utility knife or the like, and therefore are relatively inexpensive and are readily available. This reduces an operator's costs, since blades must often be replaced during operation of packaging machine 10.

Blade holder assemblies 242, 244 are constructed so as to provide quick and easy interchangeability of blades 246, 248, thus minimizing downtime of packaging machine 10 for blade replacement.

Referring again to FIG. 1, a control module 250 is mounted to an arm 252, which is pivotably connected to the upper end of the frame of upper web supply station 22. Control module 250 can be moved to varying positions by the operator of machine 10, who normally is positioned at loading station 20.

Control module 250 includes a touch screen 254 for controlling the operation of servo motors 78, 110, 170, 176 and 214. In accordance with known technology, the operation of the servo motors is controlled by programmable controllers, thereby providing very fine control of the position of the servo motor output shafts, and thereby of the packaging machine components driven by the servo motors. This is in marked contrast to prior art indexing-type packaging machines, which typically employ pneumatic cylinders for providing up and down movement of the plug assist members and the forming and evacuating boxes, and a continuously operating motor with a Geneva drive system for providing indexing advancement of the packaging webs. The servo motors are programmed so as to provide smooth and even acceleration and deceleration of the driven components and rapid intermediate movement for moving the components from one position to another. In this manner, the servo motor driven components of packaging machine 10 can be operated at a very high rate of speed, providing a dramatically increased rate of package production over conventional indexing-type machines, as well as an increased rate of production relative to continuous motion-type machines.

Another advantage offered by the use of servo motors in machine 10 is that the operating parameters can be varied by changing the program which controls the operation of the servo motors. The operating parameters are varied by use of the operator interactive touch screen 254. For example, chains **88*a* and 88*b*** lengthen slightly over time due to wear of the links. In a conventional indexing-type machine, this problem is addressed by changing the position of the forming box. With the packaging machine of the invention, the operator simply changes the operating parameters to shorten the length of the indexing web repeat, thus minimizing machine down time.

Figure 8:
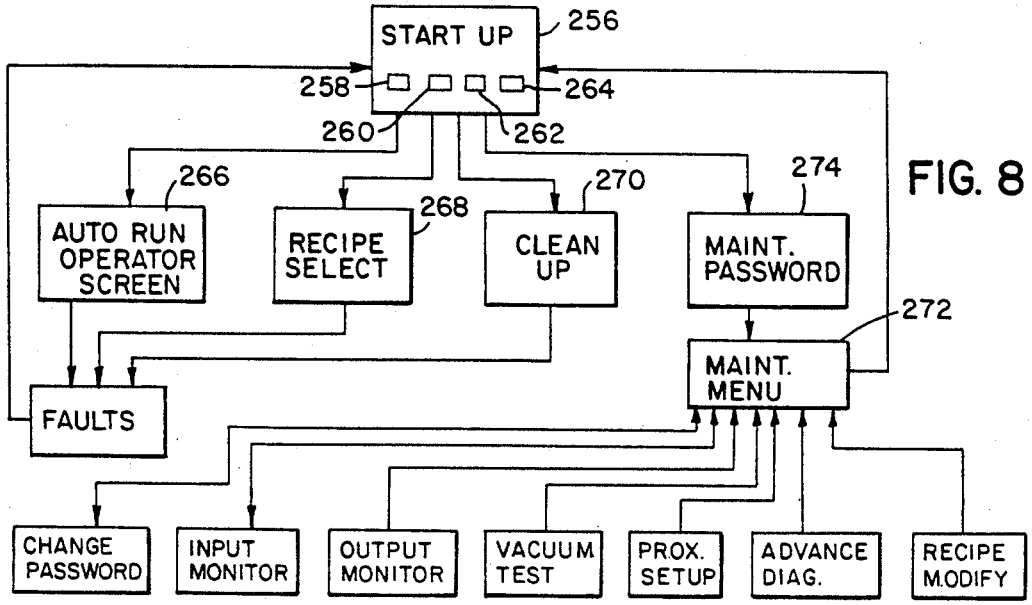
FIG. 8 is a schematic block diagram of control screen selections for controlling operation of the packaging machine.

FIG. 8 illustrates the various modes of operation selectable on touch screen 254. On start-up of machine 10, a start-up screen 256 appears, and the operator can touch one of areas 258, 260, 262 or 264 to select one of screens 266, 268, 270 or 272, which respectively comprise an automatic run operator screen, a recipe select screen, a clean-up screen and a maintenance menu screen. Maintenance menu screen 272 can only be selected upon entry of a maintenance password, represented at 274. After the various parameters are set on the appropriate screen, the operator pushes the "start" button associated with a button panel 276 (FIG. 1), to commence operation of machine 10.

Figure 9:
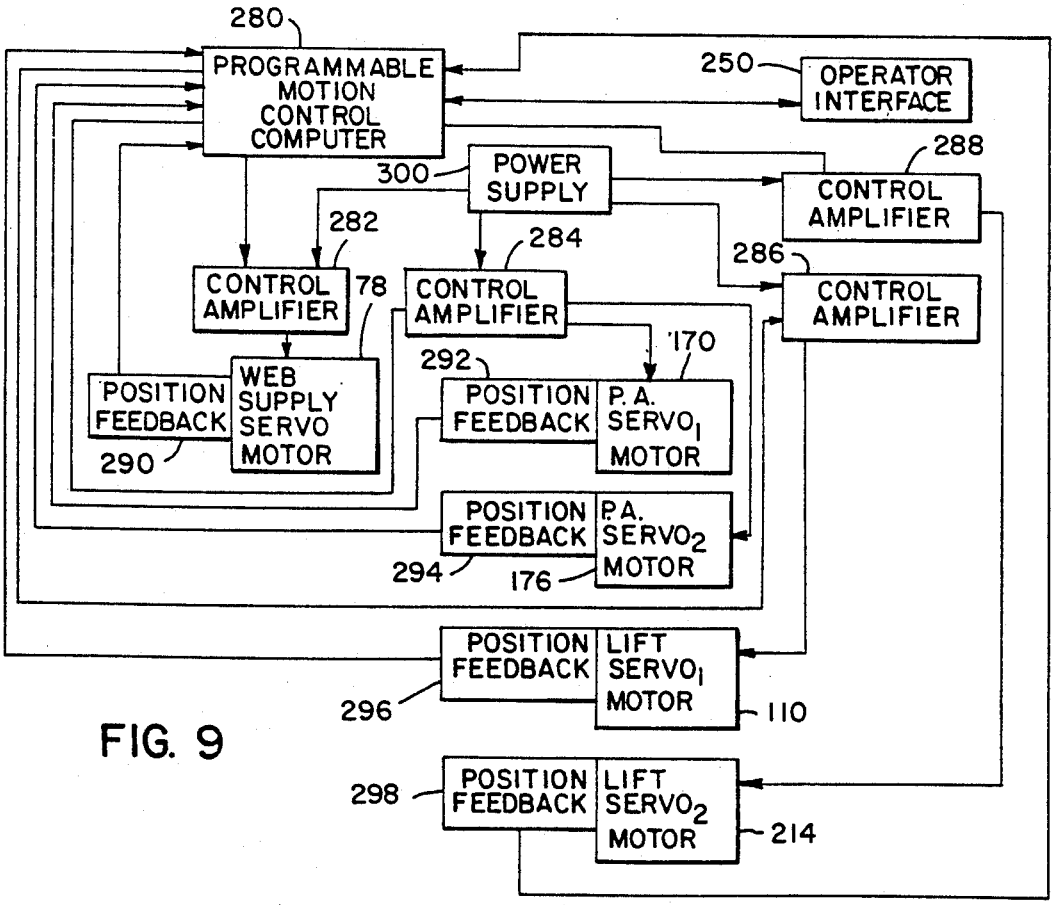
FIG. 9 is a schematic block diagram of the control and drive arrangement for the servo motors.

As also shown in FIG. 1, an enclosure 278 contains the componentry which controls the operation of the servo motors associated with packaging machine 10. Referring to FIG. 9, enclosure 278 houses a programmable motion control computer 280, which is interconnected with the operator interface control module 250. Computer 280 provides output signals to control amplifiers, such as shown at 282, 284, 286 and 288. Amplifiers 282, 284, 286 and 288 provide control signals to servo motors 78, 170, 176, 110 and 214, respectively, to control the operation of the motors and therefore the position of the respective motor output shafts. Servo motors 78, 170, 176, 110 and 214 include position sensors and feedbacks 290, 292, 294, 296 and 298, respectively, for conveying to computer 280 the actual positions of the motor output shafts. In this manner, the actual shaft position is compared with the programmed shaft position, and the motor speed is adjusted to move the motor shafts to the appropriate positions.

A power supply 300 provides power for operating the servo motors through control amplifiers 282–288, respectively.

The servo motors are preferably such as manufactured by the Gettys Corporation of Racine, Wis. under catalog number M324-P70A-1001. The motors provide rotary output power to cycloidal type gear reducers, of conventional technology. Suitable reducers are those such as manufactured under the trademark "SM-Cyclo" by Sumitomo Machinery Corporation of America, under Model No. H3105HS. The control amplifiers employed with the servo motors are preferably such as manufactured by Gould, Inc./Motion Control Division of Racine, Wis. under Model No. A700. The programmable motion control computer 280 may be such as manufactured by Giddings & Lewis Electronics under its Model No. PiC49.

Various alternatives and embodiments are contemplated as being within the scope of the following particularly pointing out and distinctly claiming the subject matter regarded as the invention.

I claim:

1. An indexing motion packaging machine, comprising:

web supply means for indexingly supplying a flexible web of packaging material to a forming station associated with the packaging machine wherein the web is temporarily maintained stationary at the forming station;

forming means located at the forming station for deforming the flexible web as it is maintained stationary at the forming station to form a cavity adapted to receive product to be packaged, the forming means including forming tooling having a forming cavity, the forming tooling being movable between a first position in which the forming tooling engages the flexible web and acts on the web to form the web into the forming cavity, and a second position in which the forming tooling is moved away from the web; and means for moving the forming tooling between its first and second positions and for temporarily maintaining the forming tooling stationary in its first position while the forming tooling engages the web and acts on the web to form it into the forming cavity, comprising motor means having a rotatable output shaft and a programmable control associated with the motor means, and means interposed between the motor output shaft and the forming tooling for moving the forming tooling between its first and second positions in response to rotation of the motor output shaft.

2. The machine of claim 1, wherein the means for moving the forming tooling between its first and second positions comprises a rotatable member drivingly engaged with the motor output shaft so as to be rotatable in response to rotation of the motor output shaft, and lifting and lowering means for lifting and lowering the forming tooling in response to rotation of the rotatable member.

3. The machine of claim 2, wherein the rotatable member comprises a shaft drivingly engaged with the rotatable motor output shaft by means of pulleys mounted to the shaft and to the motor output shaft, respectively, and a timing belt trained around the pulleys.

4. The machine of claim 1, wherein the motor means comprises a servo motor.

5. A packaging machine, comprising:

web supply means for indexingly supplying a flexible web of packaging material to a forming station associated with the packaging machine;

forming means located at the forming station for deforming the flexible web to form a cavity adapted to receive product to be packaged, the forming means including forming tooling having a forming cavity, the forming tooling being movable between a first position in which the forming tooling engages the flexible web and acts on the web to form the web into the forming cavity, and a second position in which the forming tooling is moved away from the web;

means for moving the forming tooling between its first and second positions, comprising motor means having a rotatable output shaft and a programmable control associated with the motor means; and means interposed between the motor output shaft and the forming tooling for moving the forming tooling between its first and second positions in response to rotation of the motor output shaft, comprising a rotatable member drivingly engaged with the motor output shaft so as to be rotatable in response to rotation of the motor output shaft, and lifting and lowering means for lifting and lowering the forming tooling in response to rotation of the rotatable member;

wherein the lifting and lowering means comprises a cam arrangement including structure defining a cam slot mounted to the forming tooling, an arm mounted to and rotatable with the rotatable member, and a roller member mounted to the arm and engaged within the cam slot, wherein alternating clockwise and counterclockwise rotation of the rotatable member causes back and forth movement of the roller member within the cam slot to lift and lower the forming tooling.

6. The machine of claim 5, wherein the forming tooling is mounted to a frame assembly, and wherein the cam arrangement includes structure defining a pair of cam slots mounted to the frame and spaced from each other, and further comprising a second arm mounted to and rotatable with a second rotatable member drivingly engaged with the motor output shaft, and a second roller member mounted to the second arm, wherein the first-mentioned roller member is engaged within a first one of the cam slots and the second roller member is engaged within a second one of the cam slots.

7. A method of forming a product cavity in a flexible web of packaging material, comprising the steps of:

providing forming tooling at a forming station;

indexingly supplying the flexible web to the forming station and temporarily maintaining the web stationary at the forming station; and moving the forming tooling between a first position, in which the forming tooling engages the web and is temporarily maintained stationary in its first position and acts on the web to form the product cavity as the web is maintained stationary at the forming station, and a second position in which the forming tooling is removed from the web, by operation of a motor having a rotatable output shaft and a programmable control associated with the motor, with the motor output shaft being interconnected with the forming tooling, wherein the forming tooling is movable between its first and second positions in response to rotation of the motor output shaft.

8. The method of claim 7, wherein the step of moving the forming tooling between its first and second positions comprises rotatably driving a rotatable member in response to rotation of the motor output shaft, and moving the forming tooling between its first and second positions in response to rotation of the rotatable member.

9. The method of claim 8, wherein the step of moving the forming tooling between its first and second positions in response to rotation of the rotatable member comprises providing a cam slot on the forming tooling, mounting a cam arm to the rotatable member, and engaging the cam arm within the cam slot, wherein alternating clockwise and counterclockwise rotation of the rotatable member results in back and forth movement of the forming tooling between its first and second positions.

10. A packaging machine, comprising:

an indexing mechanism for supplying a flexible web of packaging material to a forming station and for temporarily maintaining the web stationary at the forming station, comprising:

a movable advancement mechanism for gripping the flexible web;

web supply means for supplying the flexible web of packaging material to the movable mechanism; and motor means having a programmable controller associated therewith and drivingly engaged with the movable advancement mechanism, for providing an indexing advancement of the web to the forming station, wherein the web is temporarily maintained stationary at the forming station by the motor means;

forming means located at the forming station for deforming the flexible web to form a cavity adapted to receive product to be packaged while the web is maintained stationary at the forming station; and sealing means for sealing the cavity after placement of the product therein.

11. The machine of claim 10, wherein the movable advancement mechanism comprises a pair of spaced apart chains providing a series of facing gripper members for gripping the edges of the web.

12. The machine of claim 11, wherein the motor means includes a rotatable output shaft, and further comprising drive means interposed between the motor output shaft and the pair of chains for providing indexing advancement of the chains in response to intermittent rotation of the motor output shaft.

13. The machine of claim 10, wherein the motor means comprises a servo motor.

14. A method of advancing a web of packaging material in a packaging apparatus, comprising the steps of:

supplying a web of packaging material to a movable advancement mechanism;

engaging the web with the advancement mechanism so that the web is movable along with the advancement mechanism; and indexingly driving the advancement mechanism by means of a motor having a programmable controller, with the motor including an output shaft drivingly engaged with the advancement mechanism, wherein the motor functions to temporarily maintain the web stationary at the forming station.

15. The method of claim 14, wherein the movable advancement mechanism comprises a pair of spaced chains, and wherein the step of engaging the web with the advancement mechanism comprises mounting a series of gripper members to the chains which grip the edges of the web to advance the web along with the chains.

16. The method of claim 15, wherein the step of indexingly driving the advancement mechanism comprises drivingly engaging the motor output shaft with the pair of chains, and intermittently rotating the motor output shaft in response to operation of the motor to provide indexing advancement of the chains.

17. A packaging machine, comprising:

web supply means for supplying a flexible web of packaging material to a forming station;

a forming box located at the forming station and including an internal forming cavity, the forming box being movable to a forming position in which the web is located over the forming cavity;

vacuum means for providing negative air pressure to the forming cavity when the forming box is in its forming position; and means for assisting the web to conform to the contour of the forming cavity during operation of the vacuum means, comprising:

a plug member reciprocably movable between an operative position in which it engages and moves the web within the cavity to assist the web to conform to the cavity, and an inoperative position in which the plug member is withdrawn from the cavity;

motor means including an output shaft and a programmable controller associated with the motor means; and means interposed between the motor output shaft and the plug member for reciprocably moving the plug member between its operative and inoperative positions in response to operation of the motor means.

18. The machine of claim 17, wherein the plug member is mounted to a frame assembly, and wherein the means for reciprocably moving the plug member comprises means responsive to rotation of the motor output shaft for lowering and raising the frame assembly to move the plug member between its operative and inoperative positions.

19. The machine of claim 17, wherein the motor means comprises a servo motor.

20. A packaging machine, comprising:

web supply means for indexingly supplying a flexible web of packaging material to a forming station;

a forming box located at the forming station and including an internal forming cavity, the forming box being movable to a forming position in which the web is located over the forming cavity;

vacuum means for providing negative air pressure to the forming cavity when the forming box is in its forming position; and means for assisting the web to conform to the contour of the forming cavity during operation of the vacuum means, comprising:

a plug member reciprocably movable between an operative position in which it engages and moves the web within the cavity to assist the web to conform to the cavity, and an inoperative position in which the plug member is withdrawn from the cavity;

motor means including an output shaft and a programmable controller associated with the motor means; and means interposed between the motor output shaft and the plug member for reciprocably moving the plug member between its operative and inoperative positions in response to operation of the motor means;

wherein the plug member is mounted to a frame assembly, and wherein the means for reciprocably moving the plug member comprises a linear actuator connected between the motor output shaft and the frame assembly for lowering and raising the frame assembly in response to rotation of the motor output shaft.

21. The machine of claim 20, further comprising second motor means having a rotatable output shaft, and a programmable controller associated with the second motor means, and a second linear actuator interposed between the frame assembly and the output shaft of the second motor means and the frame assembly, wherein the first-mentioned and second linear actuators are connected to opposite sides of the frame assembly.

22. A method of assisting a flexible web of packaging material to conform to the internal cavity of a forming box located at a forming station of a packaging machine, in which the cavity is subjected to a vacuum, comprising the steps of:

mounting a plug member at the forming station for reciprocable movement between an operative position in which it engages the web within the cavity to assist the web to conform to the cavity while the cavity is subjected to a vacuum, and an inoperative position in which the plug member is withdrawn from the cavity; and moving the plug member between its operative and inoperative positions by operation of a motor having an output shaft, and a programmable controller associated with the motor, wherein the motor output shaft is drivingly engaged with the plug member.

23. The method of claim 22, wherein the step of mounting the plug member at the forming station comprises mounting the plug member to a reciprocably movable frame assembly located at the forming station, and wherein the step of moving the plug member between its operative and inoperative positions comprises moving the frame assembly between a lowered position and a raised position.

24. The method of claim 23, where the step of moving the frame assembly between a lowered position and a raised position comprises interconnecting the motor output shaft with the frame assembly such that the frame assembly is movable between lowered and raised positions in response to rotation of the motor output shaft.

25. A method of assisting a flexible web of packaging material to conform to the internal cavity of a forming box located at a forming station of a packaging machine, in which the cavity is subjected to a vacuum, comprising the steps of:

mounting a plug member at the forming station for reciprocable movement between an operative position in which it engages the web within the cavity to assist the web to conform to the cavity while the cavity is subjected to a vacuum, and an inoperative position in which the plug member is withdrawn from the cavity; and moving the plug member between its operative and inoperative positions by operation of a motor having a programmable controller associated therewith, and drivingly engaged with the plug member;

wherein the step of mounting the plug member at the forming station comprises mounting the plug member to a reciprocably movable frame assembly located at the forming station, and wherein the step of moving the plug member between its operative and inoperative positions comprises moving the frame assembly between a lowered position and a raised position;

wherein the motor includes a rotatable output shaft, and wherein the step of moving the frame assembly between a lowered position and a raised position comprises interconnecting the motor output shaft with the frame assembly such that the frame assembly is movable between lowered and raised positions in response to rotation of the motor output shaft; and wherein the step of interconnecting the motor output shaft with the frame assembly comprises mounting a linear actuator assembly between the motor output shaft and the frame assembly, wherein the linear actuator assembly includes a linearly movable output member, and connecting the linearly movable output member to the frame assembly such that rotation of the motor output shaft causes movement of the linear actuator output member to move the frame assembly between its lowered and raised positions.

26. The method of claim 25, further comprising the step of interconnecting a second linear actuator assembly between the frame assembly and a second motor having a rotatable output shaft and a programmable controller associated therewith, wherein the first-mentioned and second linear actuator assemblies are located on opposite sides of the frame assembly.

27. A packaging machine, comprising:

an indexing mechanism for supplying a flexible web of packaging material to a forming station located on the machine, comprising:

a movable advancement mechanism for gripping the flexible web;

web supply means for supplying a flexible web of packaging material to the movable advancement mechanism; and a first motor having a programmable controller associated therewith and drivingly engaged with the movable advancement mechanism for providing an indexing advancement of the web to the forming station;

forming means located at the forming station for deforming the flexible web to form a cavity adapted to receive product to be packaged, the forming means including forming tooling having a forming cavity, the forming tooling being movable between a first position in which the forming tooling engages the flexible web and acts on the web to form the web into the forming cavity, and a second position in which the forming tooling is moved away from the web;

means for moving the forming tooling between its first and second positions, comprising a second motor having a rotatable output shaft and a programmable controller associated with the second motor, and means interposed between the second motor output shaft and the forming tooling for moving the forming tooling between its first and second positions in response to rotation of the second motor output shaft;

vacuum means for providing negative air pressure to the forming cavity when the forming tooling is in its first position; and means for assisting the web to conform to the contour of the forming cavity, comprising:

a plug member reciprocably movable between an operative position in which it engages the web within the cavity to assist the web to conform to the cavity, and an inoperative position in which the plug member is withdrawn from the cavity;

a third motor including a rotatable output shaft and a programmable controller associated with the motor; and means interposed between the third motor output shaft and the plug member for reciprocably moving the plug member between its operative and inoperative positions in response to operation of the third motor.

28. A method of packaging an article, comprising the steps of:

supplying a web of packaging material to a forming station by means of a movable advancement mechanism;

engaging the web with the advancement mechanism so that the web is movable along with the advancement mechanism;

indexingly driving the advancement mechanism by means of a first motor having an output shaft drivingly engaged with the advancement mechanism, and a programmable controller associated with the motor;

providing forming tooling at the forming station, the forming tooling including a forming cavity;

moving the forming tooling between a first position, in which the forming tooling engages the web and acts on the web to form the product cavity, and a second position, in which the forming tooling is removed from the web, by operation of a second motor having a rotatable output shaft, and a programmable controller associated with the second motor, with the second motor output shaft being interconnected with the forming tooling, wherein the forming tooling is movable between its first and second positions in response to rotation of the second motor output shaft;

mounting a plug member at the forming station for reciprocable movement between an operative position in which it engages the web within the forming cavity to assist the web to conform to the cavity, and an inoperative position in which the plug member is withdrawn from the cavity; and moving the plug member between its operative and inoperative positions by operation of a third motor having an output shaft drivingly engaged with the plug member, and a programmable controller associated with the third motor.

* * * * *

UNITED STATES PATENT AND TRADEMARK OFFICE

CERTIFICATE OF CORRECTION

PATENT NO. : 5,205,110

DATED : April 27, 1993

INVENTOR(S) : RAYMOND G. BUCHKO

It is certified that error appears in the above-identified patent and that said Letters Patent is hereby corrected as shown below:

Claim 5, Col. 12, Line 34, before "supplying" delete "indexingly"; Claim 9, Col. 13, Line 48, after "of the" insert -- cam arm within the cam slot and thereby movement of the --; Claim 20, Col. 15, Line 13, before "supplying" delete "indexingly".

Signed and Sealed this

Fourth Day of January, 1994

*Attest:*

Bruce Lehman

BRUCE LEHMAN

*Attesting Officer*

*Commissioner of Patents and Trademarks*

US005205110C1

(12) REEXAMINATION CERTIFICATE (4346th)

United States Patent

Buchko

(10) Number: US 5,205,110 C1

(45) Certificate Issued: May 15, 2001

(54) SERVO MOTOR OPERATED INDEXING MOTION PACKAGING MACHINE AND METHOD

(75) Inventor: Raymond G. Buchko, Appleton, WI (US)

(73) Assignee: DEC International, Inc., Madison, WI (US)

Reexamination Request:
No. 90/005,631, Feb. 4, 2000

Reexamination Certificate for:

| | |
|---|---|
| Patent No.: | **5,205,110** |
| Issued: | **Apr. 27, 1993** |
| Appl. No.: | **07/626,278** |
| Filed: | **Dec. 12, 1990** |

Certificate of Correction issued Jan. 4, 1994.

(51) Int. Cl.[7] ..... B65B 47/02; B65B 47/10

(52) U.S. Cl. ..... 53/453; 53/559

(56) References Cited

U.S. PATENT DOCUMENTS

| | | | |
|---|---|---|---|
| 3,524,298 | 8/1970 | Hamilton | 53/22 |
| 3,805,486 | 4/1974 | Mahaffy et al. | 53/184 |
| 4,951,444 | 8/1990 | Epstein et al. | 53/77 |

OTHER PUBLICATIONS

"Welcome to the World of Multivac® Packaging Machines", Multivac brochure, 1988.

"Thermoforming", Modern Plastics Encyclopedia 1986–1987, Dave Irwin, pp. 322–330.

Klockner–Hooper Packaging Machines/Model 4000 advertisement, Nov. 1988.

Irwin Research Development, Inc. Engineering Drawing for Platen Assembly dated Oct. 23, 1984.

Irwin Research Development, Inc. Engineering Drawing for Main Drive Assembly dated Oct. 23, 1984.

Micro Phaser I Technical Reference Manual, Irwin Research and Development, Jul. 24, 1987.

*Primary Examiner*—Eugene Kim

(57) ABSTRACT

An indexing motion apparatus and method for vacuum packaging of articles such as hot dogs, sliced luncheon meat, cheese or pharmaceuticals. A lower web of packaging material is indexingly advanced by a lower web drive driven in an indexing manner by a servo motor. Forming tooling is provided for vacuum forming the lower web to form one or more product cavities, and the forming tooling is movable between raised and lowered positions by a lifting and lowering system driven by a servo motor. A plug assist mechanism is provided for assisting the web to conform to the forming cavities. The plug assist mechanism is also movable in response to operation of servo motors, which actuate a pair of linear actuators. After the formed product cavities are loaded with product, the cavities are evacuated and an upper web applied to vacuum package the product. A slitting mechanism severs the upper and lower webs into individual product packages. The servo motors are programmable and provide accurate position of the components of the packaging machine, and also provide ease in changing the various parameters of the packaging machine according to the type of product being packaged.

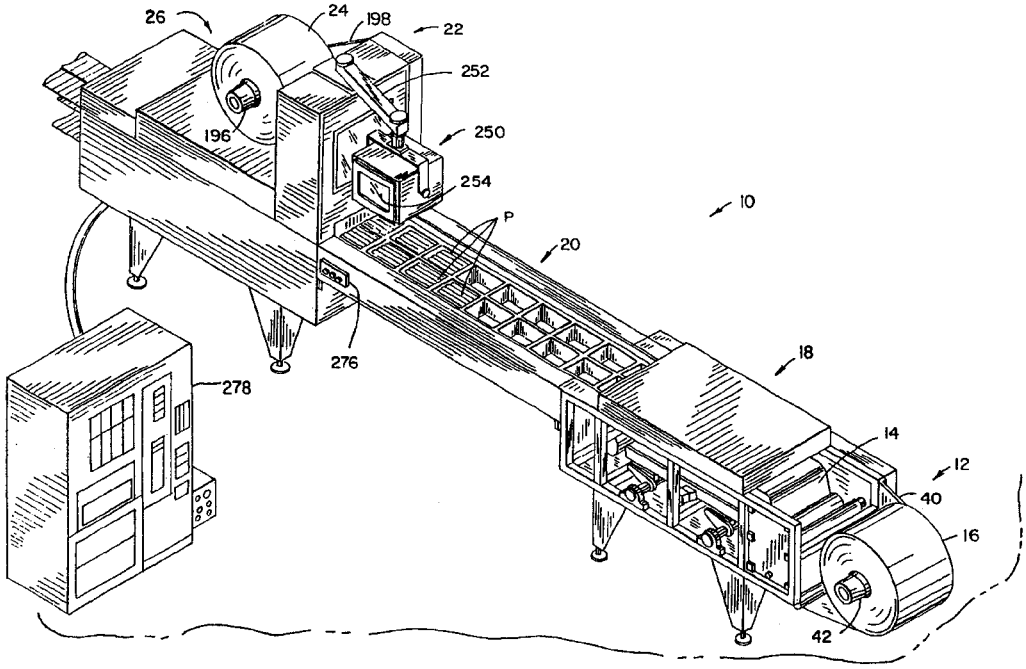

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 5, 20, 21, 25, 26, 27 and 28 is confirmed.

Claims 10, 11, 12, 13, 14, 15 and 16 are cancelled.

Claims 1, 2, 6, 7, 8, 9, 17 and 22 are determined to be patentable as amended.

Claims 3, 4, 18, 19, 23 and 24, dependent on an amended claim, are determined to be patentable.

New claims 29–39 are added and determined to be patentable.

1. An indexing motion packaging machine, comprising:

web supply means for indexingly supplying a flexible web of packaging material to a forming station associated with the packaging machine wherein the web is temporarily maintained stationary at the forming station;

forming means located *below the flexible web* at the forming station for deforming the flexible web as it is maintained stationary at the forming station to form a cavity adapted to receive product to be packaged, the forming means including forming tooling having a forming cavity, the forming tooling being movable between a first *raised* position in which the forming tooling engages the flexible web and acts on the web to form the web into the forming cavity, and a second *lowered* position in which the forming tooling is moved *downwardly* away from the web; and means for moving the forming tooling between its [first] *raised* and [second] *lowered* positions and for temporarily maintaining the forming tooling stationary in its [first] *raised* position while the forming tooling engages the web and acts on the web to form it into the forming cavity, comprising motor means having a rotatable output shaft and a programmable control associated with the motor means, and means interposed between the motor output shaft and the forming tooling for moving the forming tooling between its [first] *raised* and [second] *lowered* positions in response to rotation of the motor output shaft.

2. The machine of claim 1, wherein the means for moving the forming tooling between its [first] *raised* and [second] *lowered* positions comprises a rotatable member drivingly engaged with the motor output shaft so as to be rotatable in response to rotation of the motor output shaft, and lifting and lowering means for lifting and lowering the forming tooling in response to rotation of the rotatable member.

6. The machine of claim 5, wherein the forming tooling is mounted to a frame assembly, and wherein the cam arrangement includes structure defining a pair of cam slots mounted to the frame *assembly* and spaced from each other, and further comprising a second arm mounted to and rotatable with a second rotatable member drivingly engaged with the motor output shaft, and a second roller member mounted to the second arm, wherein the first-mentioned roller member is engaged within a first one of the cam slots and the second roller member is engaged within a second one of the cam slots.

7. A method of forming a product cavity in a flexible web of packaging material, comprising the steps of:

providing forming tooling at a forming station *below the flexible web, wherein the forming tooling defines a cavity*;

indexingly supplying the flexible web to the forming station and temporarily maintaining the web stationary at the forming station; and moving the forming tooling between a [first] *raised* position, in which the forming tooling engages the web and is temporarily maintained stationary in its [first] *raised* position and acts on the web to *deform the flexible web into the cavity of the forming tooling to* form the product cavity as the web is maintained stationary at the forming station, and a [second] *lowered* position in which the forming tooling is removed from the web, by operation of a motor having a rotatable output shaft and a programmable control associated with the motor, with the motor output shaft being interconnected with the forming tooling, wherein the forming tooling is movable between its [first] *raised* and [second] *lowered* positions in response to rotation of the motor output shaft.

8. The method of claim 7, wherein the step of moving the forming tooling between its [first] *raised* and [second] *lowered* positions comprises rotatably driving a rotatable member in response to rotation of the motor output shaft, and moving the forming tooling between its [first] *raised* and [second] *lowered* positions in response to rotation of the rotatable member.

9. The method of claim 8, wherein the step of moving the forming tooling between its [first] *raised* and [second] *lowered* positions in response to rotation of the rotatable member comprises providing a cam slot on the forming tooling, mounting a cam arm to the rotatable member, and engaging the cam arm within the cam slot, wherein alternating clockwise and counterclockwise rotation of the rotatable member results in back and forth movement of the cam arm within the cam slot and thereby movement of the forming tooling between its [first] *raised* and [second] *lowered* positions.

17. A packaging machine, comprising:

web supply means for supplying a flexible web of packaging material to a forming station;

a forming box located at the forming station *below the flexible web* and including an internal forming cavity, the forming box being *upwardly* movable to a forming position in which the web is located over the forming cavity*, and being downwardly movable to a lowered position in which the forming box is lowered away from the web*;

vacuum means for providing negative air pressure to the forming cavity when the forming box is in its forming position; and means for assisting the web to conform to the contour of the forming cavity during operation of the vacuum means, comprising:

a plug member reciprocably movable between an operative position in which it engages and moves the web within the cavity to assist the web to conform to the cavity, and an inoperative position in which the plug member is withdrawn from the cavity;

motor means including an output shaft and a programmable controller associated with the motor means; and means interposed between the motor output shaft and the plug member for reciprocably moving the plug member between its operative and inoperative positions in response to operation of the motor means.

22. A method of assisting a flexible web of packaging material to conform to the internal cavity of a forming box located at a forming station of a packaging machine, in which the cavity is subjected to a vacuum, comprising the steps of:

*mounting the forming box at the forming station below the web for reciprocable movement between a raised position in which the forming box engages the web and a lowered position in which the forming box is moved away from the web;* mounting a plug member at the forming station for reciprocable movement between an operative position in which it engages the web within the cavity to assist the web to conform to the cavity while the cavity is subjected to a vacuum, and an inoperative position in which the plug member is withdrawn from the cavity; and moving the plug member between its operative and inoperative positions by operation of a motor having an output shaft, and a programmable controller associated with the motor, wherein the motor output shaft is drivingly engaged with the plug member.

*29. A packaging machine comprising:*

*an indexing mechanism for supplying a flexible web of packaging material to a forming station and for temporarily maintaining the web stationary at the forming station, comprising: a movable advancement mechanism for gripping the flexible web; web supply means for supplying the flexible web of packaging material to the movable advancement mechanism; and first motor means having a programmable controller associated therewith and drivingly engaged with the movable advancement mechanism, for providing an indexing advancement of the web to the forming station, wherein the web is temporarily maintained stationary at the forming station by the motor means;*

*forming means located below the flexible web at the forming station for deforming the flexible web to form a cavity adapted to receive product to be packaged while the web is maintained stationary at the forming station, wherein the forming means includes forming tooling having a forming cavity, wherein the forming tooling is movable toward the web to a raised position in which the web is deformed into the forming cavity, and is movable away from the web to a lowered position in which the forming tooling is removed from the web;*

*second motor means having a programmable controller associated therewith and having a rotatable output shaft that is interconnected with the forming means for moving the forming tooling between its raised and lowered positions in response to rotation of the motor output shaft; and*

*sealing means for sealing the cavity after placement of the product therein.*

*30. The machine of claim 29, wherein the first motor means comprises a first servo motor transmitting a feedback signal to the programmable controller associated with the first servo motor and the second motor means comprises a second servo motor transmitting a feedback signal to the programmable controller associated with the second servo motor.*

*31. The machine of claim 29, wherein the sealing means comprises an evacuation box and the machine further comprises a third motor means having a programmable controller associated therewith and having a rotatable output shaft that is interconnected with the evacuation box for moving the evacuation box between a raised position and a lowered position in response to rotation of the motor output shaft of the third motor means.*

*32. The machine of claim 31, wherein the first motor means comprises a first servo motor transmitting a feedback signal to the programmable controller associated with the first servo motor, the second motor means comprises a second servo motor transmitting a feedback signal to the programmable controller associated with the second servo motor, and the third motor means comprises a third servo motor transmitting a feedback signal to the programmable controller associated with the third servo motor.*

*33. A method of advancing a flexible web of packaging material in a packaging apparatus and of forming and sealing cavities in the flexible web which are adapted to receive product to be packaged by the packaging apparatus, comprising the steps of:*

*supplying the flexible web of packaging material to a movable advancement mechanism;*

*enaging the web with the advancement mechansm so that the web is movable along with the advancement mechanism;*

*indexingly driving the advancement mechanism by means of a first motor having a programmable controller, with the first motor including a first ouptut shaft drivingly engaged with the advancement mechanism, wherein the first motor functions to temporarily maintain the web stationary at a forming station and at a sealing station;*

*moving forming tooling located at the forming station below the web, by operation of a second motor having a rotatable output shaft and a programmable controller associated therewith, wherein the forming tooling includes a cavity and is raised and lowered relative to the web by operation of the second motor and its associated output shaft;*

*forming a product cavity in the web by deforming the web into the cavity of the forming tooling when the web is maintained stationary at the forming station and the forming tooling is elevated to a location adjacent the web;*

*placing product in the product cavity; and*

*sealing the product cavity after placement of the product therein.*

*34. A method as recited in claim 33 further comprising the steps of:*

*moving an evacuation box between a raised position and a lowered position by operation of a third motor having a rotatable output shaft and a programmable controller associated therewith; and*

*evacuating a sealing compartment by operation of the evacuation box prior to sealing the product cavity with product located therein when the product cavity is located within the sealing compartment.*

*35. A method as recited in claim 33 wherein:*

*the first motor is a servo motor which transmits a feedback signal to the programmable controller associated with the first motor; and*

*the second motor is a second servo motor which transmits a feedback signal to the programmable controller associated with the second motor.*

*36. A method as recited in claim 35 further comprising the step of moving an evacuation box between a raised position and a lowered position by operation of a third motor having a rotatable output shaft and a programmable controller associated therewith, wherein the third motor is a servo motor which transmits a feedback signal to the programmable controller associated with the third motor.*

*37. A method of forming a product cavity in a flexible web of packaging material, comprising the steps of:*

*providing forming tooling at a forming station;*

*indexingly supplying the flexible web to the forming station and temporarily maintaining the web stationary at the forming station; and*

*moving the forming tooling between a first position, in which the forming tooling engages the web and is temporarily maintained stationary in its first position and acts on the web to form the product cavity as the web is maintained stationary at the forming station, and a second position in which the forming tooling is removed from the web, by operation of a motor having a rotatable output shaft and a programmable control associated with the motor, with the motor output shaft being interconnected with the forming tooling, wherein the forming tooling is movable between its first and second positions in response to rotation of the motor output shaft;*

*wherein the step of moving the forming tooling between its first and second positions comprises rotatably driving a rotatable member in response to rotation of the motor output shaft, and moving the forming tooling between its first and second positions in response to rotation of the rotatable member by providing a cam slot on the forming tooling, mounting a cam arm to the rotatable member, and engaging the cam arm within the cam slot, wherein alternating clockwise and counterclockwise rotation of the rotatable member results in back and forth movement of the cam arm within the cam slot and thereby movement of the forming tooling between its first and second positions.*

*38. The machine of claim 4, further comprising vacuum means associated with the forming tooling for supplying negative air pressure to the cavity of the forming tooling, wherein the servo motor transmits a feedback signal to the programmable controller associated with the servo motor for initiating operation of the vacuum means in response thereto.*

*39. The method of claim 8, wherein the motor comprises a servo motor, and wherein the forming tooling acts on the web to deform the web into the cavity of the forming tooling by the supply of negative air pressure to the cavity of the forming tooling from a vacuum source, and wherein operation of the vacuum source is controlled in response to a feedback signal provided by the servo motor to the programmable controller indicative of the position of the forming tooling relative to the web.*

* * * * *